United States Patent [19]

Barrett et al.

[11] Patent Number: 4,941,571

[45] Date of Patent: Jul. 17, 1990

[54] WRENCH SOCKET HOLDER

[76] Inventors: Charles G. Barrett, 247 Neptune Dr., Groton, Conn. 06340; James B. Malloy, 73 Kenney Ave., West Hartford, Conn. 06107

[21] Appl. No.: 302,315

[22] Filed: Jan. 25, 1989

[51] Int. Cl.[5] ..... A47G 29/00; B65B 85/20

[52] U.S. Cl. ..... 206/378; 211/70.6; 220/72

[58] Field of Search ..... 206/372, 337, 374, 375, 206/376, 377, 378; 211/1, 7, 66, 69, 69.5, 70.6, 124; 220/72

[56] References Cited

U.S. PATENT DOCUMENTS

| | | | |
|---|---|---|---|
| 1,712,473 | 5/1929 | McWethy . | |
| 3,405,377 | 10/1968 | Pierce . | |
| 3,726,393 | 4/1973 | Thompson . | |
| 4,043,453 | 8/1977 | Greenlee . | |
| 4,236,638 | 12/1980 | Griffith . | |
| 4,337,860 | 7/1982 | Carrigan . | |
| 4,353,465 | 10/1982 | Rado . | |
| 4,421,230 | 12/1983 | Stanton . | |
| 4,588,087 | 5/1986 | Swingley, Jr. | 220/72 |
| 4,621,738 | 11/1986 | DeLucchi . | |
| 4,688,672 | 8/1987 | Pemberton . | |
| 4,714,158 | 12/1987 | Oltman . | |

*Primary Examiner*—Paul T. Sewell
*Assistant Examiner*—Jacob K. Ackun, Jr.
*Attorney, Agent, or Firm*—McCormick, Paulding & Huber

[57] ABSTRACT

A wrench socket holder molded from resilient, flexible plastic material of substantially uniform thickness and having an elongated base portion reinforced by a plurality of ribs. A longitudinally spaced apart series of trapezoidal shape wrench retaining members mounted on stems project upwardly from the upper surface of the base portion. Each resilient flexible wrench retaining member is adapted for forcible entry into the handle receiving opening of an associated wrench socket element to resiliently grip and frictionally engage and releasably retain the wrench socket element in assembly with the holder.

20 Claims, 1 Drawing Sheet

WRENCH SOCKET HOLDER

BACKGROUND OF THE INVENTION

This invention relates in general to article supporting devices and deals more particularly with improvements in wrench socket holders for storing a set of graduated wrench sockets in an organized manner.

Heretofore wrench socket holders have been available and examples of such holders are found in the following listed U.S. Pat. Nos.

| | | |
|---|---|---|
| 1,712,473 | 3,726,393 | 4,337,860 |
| 4,621,738 | 4,714,158 | 3,405,377 |
| 4,043,453 | 4,421,230 | 4,688,672 |

The general aim of the present invention is to provide an improved wrench socket holder of lightweight durable construction for low cost manufacture.

SUMMARY OF THE INVENTION

In accordance with the present invention a unitary wrench socket holder made from resilient, flexible material includes an elongated support base, a plurality of resilient flexible wrench retaining members, each of said members having opposing side edges converging in a direction away from said support base, and attaching means for connecting each of said wrench retaining members in and upwardly projecting relation to said support base for flexure in generally tangential directions about an upwardly extending central axis relative to said support base.

DETAILED DESCRIPTION OF PREFERRED EMBODIMENT

Figures 1, 2, 3, 4, 5, 6, 7, 8:
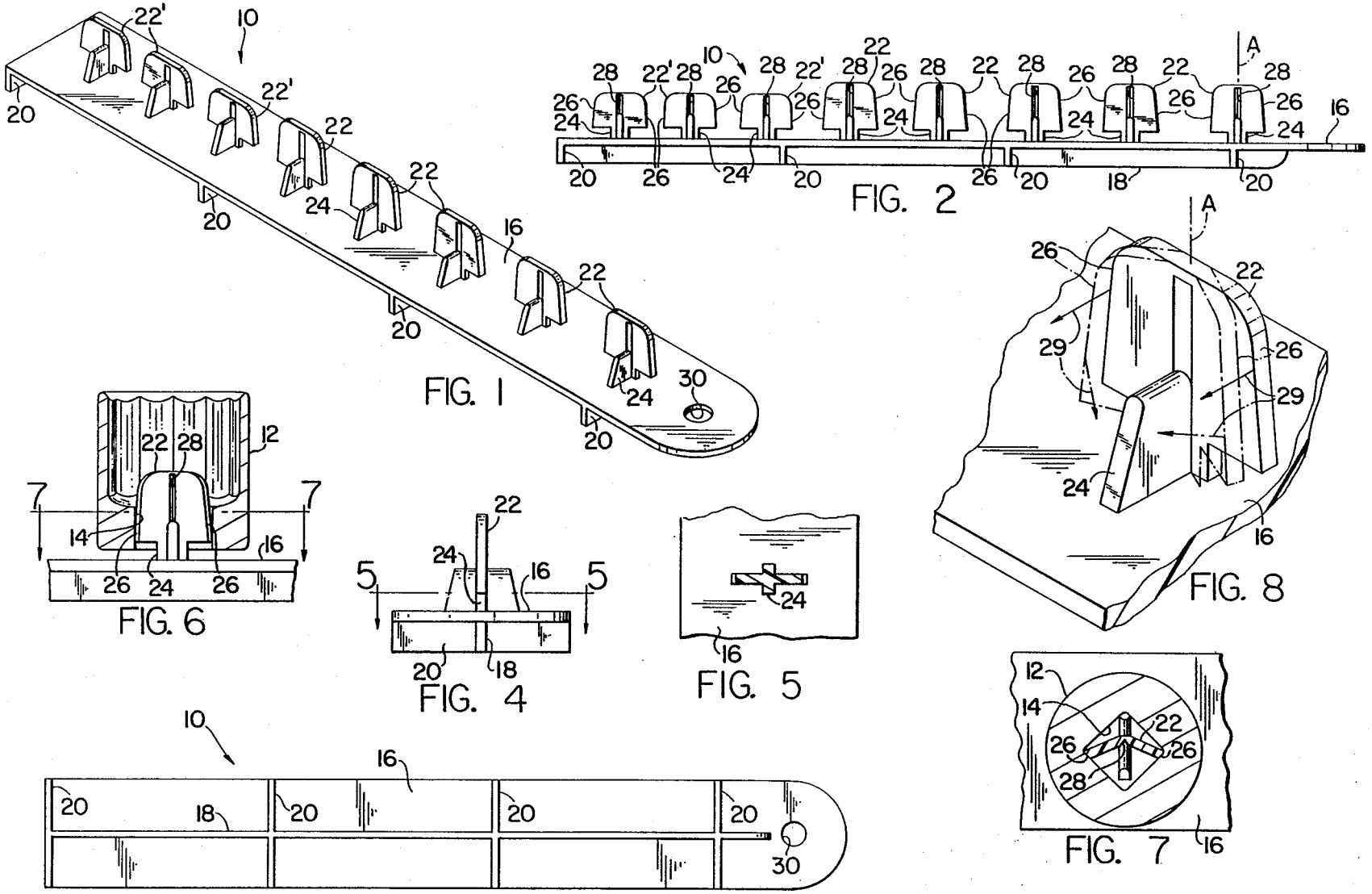
FIG. 1 is a perspective view of a wrench socket holder embodying the present invention.
FIG. 2 is a side elevational view of the wrench socket holder.
FIG. 3 is a bottom view of the wrench socket holder.
FIG. 4 is a somewhat enlarged end view of the wrench socket holder.
FIG. 5 is a sectional view taken along the line 5—5 of FIG. 4.
FIG. 6 is a somewhat enlarged fragmentary side elevational view of the wrench socket holder shown with a wrench socket element supported thereon, the socket element being shown in section.
FIG. 7 is a fragmentary sectional view taken along the line 7—7 of FIG. 6.
FIG. 8 is a somewhat enlarged fragmentary perspective view and shows the direction of flexure of a typical wrench socket retaining member.

Turning now to the drawing, a wrench socket holder embodying the present invention is indicated generally by the reference numeral 10. The illustrated holder 10 is particularly adapted to support a set of wrench socket elements of graduated size adapted for selected use with a common drive handle. Consequently, each socket element in the set has a handle receiving opening of non-circular cross-section for receiving and substantially complementing an associated tang on a wrench drive handle. A typical wrench socket element shown in section in FIGS. 6 and 7 and indicated by the numeral 12 has a handle receiving opening 14 of square cross-section for receiving and complementing a square end portion of an associated wrench handle tang (not shown).

The wrench socket holder of the present invention may be made from a variety of materials and may take various forms, but preferably, and as shown, the socket holder 10 comprises a unitary structure molded from durable, resilient, flexible, lightweight plastic material and has a substantially uniform thickness. It includes an elongated base portion 16 which is preferably generally rectangular and rounded at one end, substantially as shown. At least one rib formed on the base stiffens it against longitudinal flexure, but preferably and as shown a plurality of ribs 18 and 20,20 project from the base portion 16 and stiffening it to resist flexure in both longitudinal and transverse directions. The central rib 18 extends longitudinally along the base portion 16 from one end thereof and terminates in spaced relation to the other end of the base portion. The ribs 20,20 extend transversely of the base in intersecting relation to the rib 18.

A plurality of resilient flexible socket retaining members indicated generally at 22 and 22' are mounted in longitudinally spaced apart series on the upper surface of the base portion 16. Preferably, and as best shown in FIG. 2, the socket retaining members are arranged in progressively increasing spaced apart relation to each other along the base. Each socket retaining member is adapted to be received within the handle receiving opening 14 of an associated wrench socket element, such as the socket element 12, to resiliently grip and frictionally engage the socket element within the opening 14 and thereby releasably retain the socket element in assembly with the holder 10. The wrench retaining members may be substantially identical in both size and shape. However, the retaining members 22',22' of the illustrated wrench holder 10 are of somewhat lesser height than the retaining members 22,22 to accommodate wrench socket elements of smaller size.

A typical wrench retaining member 22, best shown in FIGS. 6 and 7, is supported in spaced relation to the base portion 16 by an associated stem 24 which projects upwardly from the upper surface of the base portion and has a cruciform cross-section, as best shown in FIG. 5. Preferably, and as shown, the retaining member 22 has a quadrilateral form, a generally rectangular cross-section as viewed from above, and is generally symmetrical about a central axis A normal to the upper surface of the base portion 16 and passing centrally through the stem 24. The illustrated retaining member 22 has a right trapezoidal form and is characterized by opposite side edges 26,26 which converge in a direction away from the base portion 16, substantially as shown. The base width of the trapezoidal retaining member 22 is slightly greater than the major or diagonal dimension of the socket retaining opening 14 whereas the free end portion of the trapezoidal retaining member is of somewhat lesser width than the major or diagonal dimension of the socket retaining opening 14. The upper corners of the trapezoidal retaining member are preferaby slightly rounded, substantially as shown, to provide lead surfaces for smooth entry into the handle receiving opening 14 of associated wrench socket element. A slight axially extending recess or groove 28 is formed in at least one side of each wrench retaining member and defines a region of weakening to increase the flexibility of the member in tangential directions about its central axis or its axis of symmetry A. In FIG. 8 directions of tangential flexure of a typical wrench retaining member 22 about its central axis A are shown by directional arrows indicated by the numeral 29.

A hole 30 formed in one end of the base portion 16 facilitates hanging of the wrench socket holder 10 on a wall or the like.

Each wrench socket element is retained on the holder 10 by forcible assembly with an associated retaining member 22. When a socket element, such as the socket element 12, is forced downwardly over the retaining member, the retaining member enters the handle receiving opening 14 in the socket element and flexes about its axis A to a general position such as shown in FIG. 7 to resiliently grip and frictionally engage and releasably retain the socket element on the holder 10.

I claim:

1. Wrench socket holder comprising a support base, a resilient flexible wrench socket retaining member having a pair of upwardly converging opposite edges, an attaching means for connecting said wrench socket retaining member to said support base for flexure in generally tangential directions about an upwardly extending axis of symmetry of said wrench socket retaining member, said axis being generally normal to said support base, said flexure causing each of said opposite edges to move in an arc about said upwardly extending axis of symmetry.

2. Wrench socket holder comprising a support base, a resilient flexible wrench socket retaining member, and a stem connecting said wrench socket retaining member to said support base and supporting said wrench socket retaining member in projecting relation to said support base for flexure in generally tangential directions about an axis of symmetry of said wrench socket retaining member coincident with the longitudinal axis of said stem and generally normal to said support base whereby said flexure causes portions of said retaining member to move in an arc about said axis.

3. Wrench socket holder as set forth in claim 2 wherein said stem has a cruciform cross-section.

4. Wrench socket holder comprising a support base, a plurality of resilient flexible wrench socket retaining members, each of said socket retaining members having a pair of upwardly converging opposite side edges, and attaching means for connecting each of said wrench socket retaining members to said support base and supporting each of said wrench socket retaining members in upwardly extending relation to said support base for flexure in generally tangential directions about an upwardly extending central axis and including a plurality of stems equal in number to said wrench socket retaining members, each of said stems having a cruciform cross-section, each of said wrench socket retaining members being connected to said support base by an associated one of said stems said flexure causing each of said side edges to move in an arc about said upwardly extending central axis.

5. Wrench socket holder comprising a support base, a resilient flexible wrench socket retaining member, and a stem having a cruciform cross-section and connecting said wrench socket retaining member to said support base and supporting said wrench socket retaining member in projecting relation to said support base for flexure in generally tangential directions about an axis of said wrench socket retaining member passing through said support base whereby said flexure causes portions of said retaining member to move in an arc about said axis.

6. Wrench socket holder comprising a support base, a plurality of resilient flexible wrench socket retaining members, each of said socket retaining members having a pair of upwardly converging opposite side edges, and attaching means for connecting each of said wrench socket retaining members to said support base and supporting said socket retaining members in upwardly extending relation to said support base for flexure in generally tangential directions about an upwardly extending central axis said flexure causing each of said side edges to move in an arc about said upwardly extending central axis.

7. Wrench socket holder as set forth in claim 6 wherein each of said wrench socket retaining members has a substantially rectangular cross-section.

8. Wrench socket holder as set forth in claim 7 wherein said wrench socket retaining members comprise a plurality of substantially identical members.

9. Wrench socket holder as set forth in claim 6 wherein said holder comprises a one piece structure formed from resilient flexible plastic material of substantially uniform thickness.

10. Wrench socket holder as set forth in claim 9 including means for stiffening said base to reduce flexibility thereof.

11. Wrench socket holder as set forth in claim 10 wherein said means for stiffening said base comprises at least one rib projecting from said base.

12. Wrench socket holder as set forth in claim 11 wherein said support base comprises an elongated base, said one rib comprises a longitudinally extending rib, and said stiffening means includes another transversely extending rib.

13. Wrench socket holder as set forth in claim 6 wherein said attaching means comprises a plurality of stems projecting upwardly from the base and equal in number to said wrench socket retaining members, each of said wrench socket retaining members being connected in spaced relation to said support base by an associated one of said stems.

14. Wrench socket holders set forth in claim 6 wherein each of said wrench socket retaining members has a trapezoidal shape.

15. Wrench socket holder as set forth in claim 14 wherein said wrench socket retaining members comprise right trapezoids.

16. Wrench socket holder as set forth in claim 6 for a set of wrench socket elements, each of said wrench socket elements including a handle receiving recess having a non-circular cross-section, each of said socket retaining members including a free upper end portion having a transverse dimension not greater than the major cross-sectional dimension of the non-circular cross-section and a base dimension greater than the major dimension of the non-circular cross-section.

17. Wrench socket holder comprising a unitary structure formed from resilient flexible plastic material of substantially uniform thickness and including an elongated base portion, means for stiffening said base portion to reduce flexibility thereof, a plurality of resilient flexible generally trapezoidal shape wrench socket retaining members, having upwardly converging opposite side edges, and attaching means for connecting said wrench socket retaining members to said base portion in longitudinally spaced apart series therealong and including a plurality of stems equal in number to said wrench socket retaining members, each one of said stems being integrally connected to one surface of said base portion and to an associated one of said wrench socket retaining members and projecting upwardly from said one surface and supporting said associated one wrench socket retaining member in upwardly spaced relation to said one surface for flexure in generally tangential directions about an upwardly extending axis of symmetry of said associated one of said wrench socket retaining members and passing through centrally said one stem, said flexure causing each of said side edges to move in an arc about said upwardly extending axis of symmetry.

18. Wrench socket holders as set forth in claim 17 wherein said base portion is generally rectangular and includes a plurality of stiffening ribs projecting from the lower surface thereof and extending longitudinally and transversely thereof.

19. A wrench socket holder as set forth in claim 18 wherein said base member has a laterally centered aperture therethrough near one end thereof.

20. Wrench socket holder comprising a one-piece structure made from resilient flexible material of substantially uniform thickness and having an elongated base portion, and a plurality of wrench socket retaining members, each of said wrench socket retaining members being supported on and projecting upwardly from the upper surface of said base portion for resilient flexure in generally tangential directions about a vertical axis, each of said wrench socket retaining members having upwardly converging opposite side edges, said wrench socket retaining members being arranged in longitudinal series and progressively increasing spaced apart relation to each other along said base portion said flexure causing each of said side edges to move in an arc about said vertical axis.

* * * * *